United States Patent [19]

Gross

[11] 4,228,929

[45] Oct. 21, 1980

[54] STAND FOR HOLDING A BEER KEG IN POSITION FOR GRAVITY FEED

[75] Inventor: Charles Gross, Saddle Brook, N.J.

[73] Assignee: Vending Components, Inc., Hackensack, N.J.

[21] Appl. No.: 35,218

[22] Filed: May 2, 1979

[51] Int. Cl.[3] ..... B67D 1/06

[52] U.S. Cl. ..... 222/185

[58] Field of Search ..... 222/181, 184, 185, 186; 248/173, 165, 168, 170, 436, 188, 172

[56] References Cited

U.S. PATENT DOCUMENTS

| | | | |
|---|---|---|---|
| 1,209,388 | 12/1916 | Brown | 248/173 |
| 2,880,951 | 4/1959 | Springer | 248/172 X |
| 3,957,176 | 5/1976 | Marston | 222/185 |

*Primary Examiner*—Stanley H. Tollberg
*Attorney, Agent, or Firm*—Roy C. Hopgood; John M. Calimafde; Charles W. Neill

[57] ABSTRACT

This invention provides for the dispensing of beer from a keg by gravity. A stand is detachably connected with the upper end of the keg, and the keg is then turned upside down. The stand supports the keg with the lowermost end of the keg spaced above the floor or ground or other surface with enough clearance under the keg for a person to reach under the keg to operate a valve which is located in the lowermost end of the keg when a keg, made for use with conventional tapping equipment, is to be used in an upside down position. The stand preferably folds when not in use and can be detachably secured to the keg without the use of tools.

7 Claims, 7 Drawing Figures

STAND FOR HOLDING A BEER KEG IN POSITION FOR GRAVITY FEED

BACKGROUND AND SUMMARY OF THE INVENTION

When beer is dispensed from kegs in taverns, gas under pressure is introduced into the keg above the beer and the beer is pushed out of the keg by the gas pressure through a down tube connected with a valve at the top of the keg and extending down to a location near the bottom of the keg. For picnics and other occasions where the gas pressure used in taverns is not available, the kegs are turned upside down and the beer is withdrawn from the keg by gravity. This has a number of disadvantages. For example, the valve fitting is at the lower most end of the keg and inaccessible unless the keg is held in a position spaced from an underlying support, and the makeshift supports that are used involve the risk that the beer keg may be displaced from the supports with the result that picnickers are injured or the keg and the beer dispensing connections may be damaged.

This invention provides a stand or frame by which the beer keg can be supported in an upside down position, with the stand resting on a rigid support and the lower most end of the keg held at a spaced distance above the support so that the valve fng at the lower end of the keg is conveniently accessible.

In the preferred embodiment of the invention, the stand or frame can be secured to the keg by clamping means and without the use of tools. The stand is also preferably made in such a way that it can be folded into a small space when not in use.

The stand can be made with three legs disposed at 120 degree spacing around the circumference of the lower end of the keg so that the keg is stable with three point support even when placed on the ground which may not be flat. Each of the legs preferably has a foot for preventing it from sinking into soft ground.

A hose is attached at one end to the fitting which is ordinarily used to supply gas to the keg and a manually operated valve on the other end of the hose is used for filling successive glasses at locations near the keg but not under it.

Other objects, features and advantages of the invention will be pointed out or become apparent as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
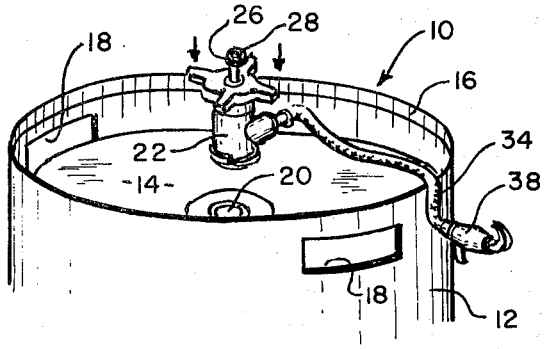
FIG. 1 is a perspective view showing the upper end of a conventional beer keg with a hose secured to the fitting through which gas is ordinarily supplied to the keg; and with the usual valve fitting in position to be inserted and locked into the outlet in the upper end of the keg.

FIG. 1 shows the upper end of a beer keg (10) which has a cylindrical sidewall (12) and an upper wall (14) which is connected with the sidewall (14) in such a way as to enclose one end of the chamber in which the beer is confined in the keg. The keg (10) has a bead (16) at its upper end which is shown in section on a larger scale in FIG. 7.

There are hand holes (18) through the sidewall (12) above the end wall (14) for lifting the keg when necessary.

A socket (20) is secured to the wall (14) and it has an opening into which the lower end of a valve fitting (22) can be inserted with cam means for locking the valve fitting into the opening (20).

A valve (24) (FIG. 2) is located within the valve fitting (22); and when the keg is to be used in a tavern, there is a hose fitting extending upward from the valve fitting (22) through a handle (25) for connecting beer lines to the keg. When the keg is to be used upside down, in accordance with the present invention, a purge element (26) extends upward through the handle (25) and there is an opening (28) which communicates with the down tube which leads from the socket (20) to a location near the other end of the keg.

A down tube (30) is shown in dotted lines in FIG. 6 and when the keg (10) is turned upside down as in FIG. 6, and the purge element (26) is open, any beer in the keg above the upper end of the down tube (30) will flow out through the purge (26); and when the top surface of the beer is below the upper end of the down tube (30) air can enter through the purge element (26) and flow upward through the down tube so as to maintain atmospheric pressure on top of the beer. The arrows (32) represent the flow of air into the keg (10) as beer is withdrawn from the lower end of the keg through a hose (34) which leads from the valve fitting (22) at an outlet (36) through which gas enters the keg (10) when the keg is used in the conventional way. When the keg (10) is used upside down, according to this invention, there is a valve (38) at the end of the hose (34) with a handle (40) for opening the valve to permit beer to run out through the hose (34) for filling glasses or mugs.

Figure 4:
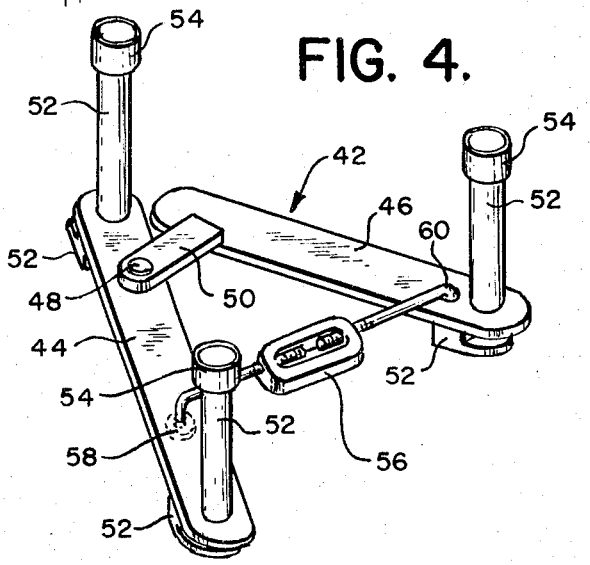
FIG. 4 is a view of the stand, shown in FIG. 3, when detached from the keg.

FIG. 4 shows the frame of this invention designated generally by the reference character 42. The frame (42) has two links (44 and 46) which are connected together by a pivot (48) at the end of a crank (50) which is preferably of one piece construction with the link (46). There are legs (50) at both ends of the link (44) and a leg (52) at one end of the link (54). These legs (52) can be made of pipe with caps (54) screwed or otherwise secured to the ends of the legs which constitute the lower ends when the frame (42) is being used to support a keg (10) as in FIGS. 5 and 6. The other ends of the legs (52) are rigidly secured to the links (44 and 46).

Figure 2:
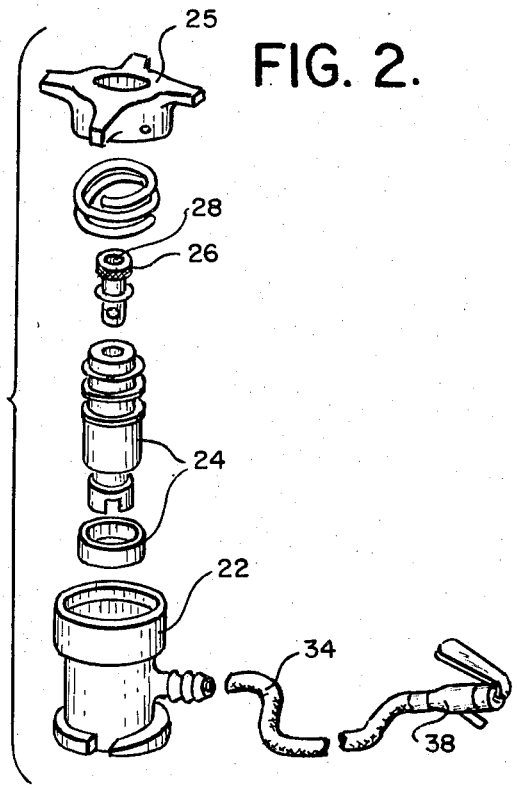
FIG. 2 is an exploded view of the valve fitting shown in FIG. 1.
Figure 3:
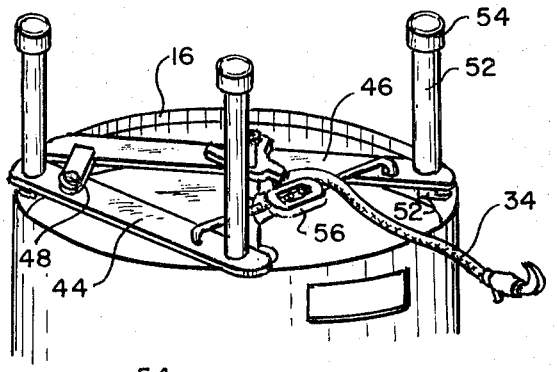
FIG. 3 shows the stand of this invention secured to the upper end of the keg of FIG. 1.

Each end of the link (44) has a block (52) secured to it and there is a similar block (52) secured to the link (46) at the end remote from the link (53). FIG. 2 is a diagrammatic sectional view showing the link (44) with the leg (53) extending downwardly as in FIG. 6 and with the block (52) secured to the link (44) and shaped to provide a recess (54) into which the bead (16) of the keg extends. The block (52) may be secured to the link (44) in any suitable manner, or can be made as one piece with the link (44).

Figure 7:
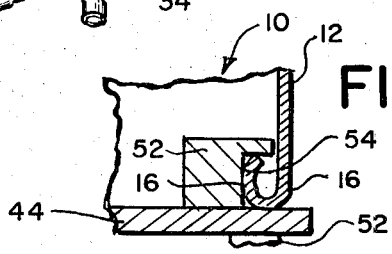
FIG. 7 is a greatly enlarged fragmentary sectional view showing the way in which the frame engages a bead at the bottom of the wall of the keg to secure the stand rigidly to the keg.

Before the frame (42) is secured to the keg, the links (44 and 46) are brought into substantially parallel relation with one another by rocking the crank (50) about pivot (48). Since none of the links (44 or 46) is equal to the diameter of the keg as measured inside the bead (16), all of the blocks (52) can be brought within the space surrounded by the bead (16) and the links (44 and 46) are then moved within this space to bring the blocks (52) of the link (44) into position to engage the bead (16) while the link (44) bears against the bottom of the bead, as shown in FIG. 7. The link (46) is then moved about the pivot (48) until its block (52) moves into position to engage the bead (16); a turnbuckle (56) is connected with the link (44) by a loose or universal connection (58) but is not connected with the other link (46) until after all of the links are brought into position to engage the bead (16).

Turnbuckle (56) is then adjusted so that its end (60), remote from the universal connection (58), can engage in an opening through the link (56) to prevent relative movement of the links (44 and 46) about the axis of the pivot (48). Thus the turnbuckle holds all three of the blocks (52) snugly against the bead (16) and thereby anchors the frame (42) to the bottom end of the keg (10).

Figure 6:
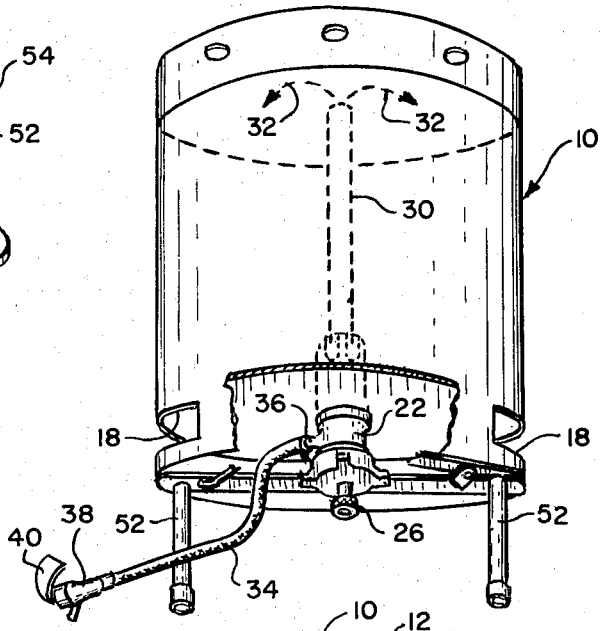
FIG. 6 is a view of the keg, partly broken away to show the valve fitting; and viewed from a low angle so as to better illustrate the way in which the stand is attached to the end of the keg.

The turnbuckle (56) is representative of means for adjusting the link (46) and its leg (52) with respect to the other link (44) and its legs so as to locate the three legs at locations around the keg corresponding to spacing of approximately sixty degrees from one another to provide maximum stability for the keg when supported by the legs (52) as shown in FIG. 6.

In the construction illustrated in the drawing, the links (44 and 46) are flat so as to provide larger areas of support for the bead at the bottom of the keg and the pivot (48) is long enough axially to maintain the links (44 and 46) in a common plane. It will be apparent, however, that other shapes can be used and that other mechanical expedients can be employed in place of the turnbuckle (56).

Figure 5:
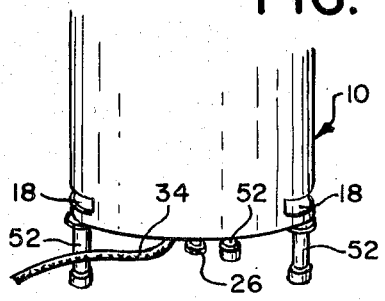
FIG. 5 is a reduced scale view showing the keg of FIG. 3 turned upside down and supported by the legs of the stand shown in FIGS. 3 and 4.

FIG. 5 shows the purge element (26) extending downward but supported by the legs (52) at an elevation which permits a person's hand to reach under the keg (10) to open the purge element (26) so that air can enter the keg as beer is withdrawn through the hose (34).

The preferred embodiment of the invention has been illustrated and described, but changes and modifications can be made and some features can be used in different combinations without departing from the invention as defined in the claims.

What is claimed is:

1. The combination with a beer keg, or the like, having an end that comprises the top of the keg when the keg is in an upright position, an opening through said top communicating with the interior of the keg, a supporting frame that fits over the top of the keg and that extends across the top with an opening in the frame that leaves the center portion of the top unobstructed, characterized by detachable fastening means for securing the frame to the keg with the frame extending upward above the top of the keg and above the upper end of said opening, the frame extending beyond the top of the keg far enough to space the opening in the end of the keg from a substantially horizontal surface over which the keg is supported when turned upside down, the frame being long enough to support the keg over said substantially horizontal surface with space between the keg and said horizontal surface to provide clearance for a hand to reach under the upside down keg to said opening through the end of the keg, and the frame having part of the circumference thereof open to provide access for a hand to reach under the end of the keg to said opening, and further characterized by the frame having elements that fold with respect to one another including an element that moves into one position that prevents the elements from folding with respect to one another and that moves into another position to permit the elements to be disconnected from the keg and folded into a space of lesser extent than they occupy when secured to the keg.

2. The combination described in claim 1 characterized by said element that moves into different positions for controlling the clamping of the frame to the keg including a link with ends that connect with other parts of the frame and said element having screw threads thereon which rotate in a threaded socket to effect the clamping of the frame to the keg and adjustable to change the friction of the clamping action.

3. The combination described in claim 1 characterized by the frame including links that are connected with one another and that contact with the end of the keg in locations around the circumference of the end of the keg, said locations being spaced around the circumference of the keg at spacings no greater than approximately 120 degrees.

4. The combination with a beer keg, or the like, having an end that comprises the top of the keg when the keg is in an upright position, an opening through said top communicating with the interior of the keg, a supporting frame that fits over the top of the keg and that extends across the top with an opening in the frame that leaves the center portion of the top unobstructed, characterized by detachable fastening means for securing the frame to the keg with the frame extending upward above the top of the keg and above the upper end of said opening, the frame extending beyond the top of the keg far enough to space the opening in the end of the keg from a substantially horizontal surface over which the keg is supported when turned upside down, the frame being long enough to support the keg over said substantially horizontal surface with space between the keg and said horizontal surface to provide clearance for a hand to reach under the upside down keg to said opening through the end of the keg, and the frame having part of the circumference thereof open to provide access for a hand to reach under the end of the keg to said opening, and further characterized by the frame comprising at least three links with each pivotally connected with one another including a pivot connection between two of the links on which the links can fold into smaller space when not in use, one of the links having multiple parts that are connected together by screw threads which are adjustable when the frame is in unfolded condition to cause the frame to grip and hold the frame in fixed position on the keg.

5. The combination described in claim 4 characterized by the link with the multiple parts including a turnbuckle that tightens and loosens the frame contact with the keg.

6. The combination described in claim 4 characterized by ends of the links that contact with the end of the keg having surfaces that extend under the end of the keg and having shoulders adjacent to said surfaces for clamping against the side wall of the keg adjacent to the surfaces under the end of the keg.

7. The combination described in claim 4 characterized by legs secured to the links and extending away from the links for spacing a keg on the links above the support on which the ends of the legs remote from the links rest; said legs having supporting surfaces at either ends remote from the links, the supporting surfaces being of larger area than the cross-sections of the legs.

* * * * *